US007539324B2

(12) United States Patent
Polfreman et al.

(10) Patent No.: US 7,539,324 B2
(45) Date of Patent: May 26, 2009

(54) LOUDSPEAKER DIAPHRAGM SYSTEMS

(75) Inventors: Robert Polfreman, Kidderminister (GB); Michael Harris, Cardiff (GB)

(73) Assignee: Harman International Industries, Incorporated, Northridge, CA (US)

( * ) Notice: Subject to any disclaimer, the term of this patent is extended or adjusted under 35 U.S.C. 154(b) by 414 days.

(21) Appl. No.: 10/519,760

(22) PCT Filed: Jul. 4, 2003

(86) PCT No.: PCT/EP03/07189

§ 371 (c)(1),
(2), (4) Date: Oct. 28, 2005

(87) PCT Pub. No.: WO2004/006623

PCT Pub. Date: Jan. 15, 2004

(65) Prior Publication Data

US 2006/0104473 A1 May 18, 2006

(30) Foreign Application Priority Data

Jul. 8, 2002 (GB) ..... 0215767.5
Jul. 8, 2002 (GB) ..... 0215768.3

(51) Int. Cl.
*H04R 11/02* (2006.01)

(52) U.S. Cl. ..... 381/423; 381/426

(58) Field of Classification Search ..... 381/426, 381/427, 428; 181/157, 167, 168, 169, 170, 181/174
See application file for complete search history.

(56) References Cited

U.S. PATENT DOCUMENTS

| | | | | |
|---|---|---|---|---|
| 1,715,598 | A * | 6/1929 | Hawley et al. | 181/164 |
| 3,125,647 | A * | 3/1964 | Rouy | 381/432 |
| 4,726,443 | A * | 2/1988 | Ugaji et al. | 181/167 |
| 6,327,372 | B1 * | 12/2001 | Devantier et al. | 381/426 |
| 2002/0184964 | A1 | 12/2002 | Pearsall et al. | |

FOREIGN PATENT DOCUMENTS

| | | |
|---|---|---|
| DE | 902260 | 1/1954 |
| DE | 3831376 | 3/1990 |
| GB | 255736 | 7/1926 |
| GB | 369992 | 3/1932 |
| JP | 55064602 | 5/1980 |
| JP | 61251298 | 8/1986 |
| JP | 63143000 | 6/1988 |

* cited by examiner

*Primary Examiner*—Brian Ensey
(74) *Attorney, Agent, or Firm*—Brinks Hofer Gilson & Lione

(57) ABSTRACT

A loudspeaker diaphragm includes a continuous coating on at least one surface of the diaphragm. The continuous coating may be non-uniform and may taper from a maximum in value in a conical region of the diaphragm to a minimum value in a cylindrical region of the diaphragm. The coating is formed in a single coating step without the need for use of a contact mask or interruption of the process to change process parameters. The tapered coating is formed by controlling the current density distribution within an electrochemical cell such that the rate of formation of the coating tapers from a first value in the conical region of the diaphragm to a second value is the cylindrical region of the diaphragm.

28 Claims, 13 Drawing Sheets

LOUDSPEAKER DIAPHRAGM SYSTEMS

PRIORITY CLAIM

This application claims the benefit of Great Britain Application No. 0215767.5, filed Jul. 8, 2002 and Great Britain Application No. 0215768.3, filed Jul. 8, 2002. The disclosures of the above applications are incorporated herein by reference.

BACKGROUND OF THE INVENTION

1. Technical Field

This application relates to loudspeaker diaphragm systems and more particularly to loudspeaker diaphragms that have a continuous, non-uniform coating formed on at least one surface of the diaphragm.

2. Related Art

Loudspeaker diaphragms have characteristic resonances that are determined by the dimensions, stiffness, and density of the diaphragm. Diaphragms constructed from aluminum have characteristic resonances that tend to fall in the audible frequency range resulting in a negative effect on the acoustic performance. Sounds emitted from loudspeakers having aluminum diaphragms may appear harsh to the listener, thereby affecting the acoustic quality of the loudspeaker.

Manufacture of some loudspeaker diaphragms includes the formation of an oxide layer by anodization on one or both surfaces of the diaphragm to increase the stiffness of the structure. The increased stiffness causes the resonant frequencies of the structure to rise, thus extending the usable bandwidth of the loudspeaker, and flattening the frequency response curve. As a result, the acoustic performance of the diaphragm, and hence the loudspeaker, may be improved.

Anodization may cause a weakening of the aluminum loudspeaker diaphragm because aluminum from the surface of the diaphragm is consumed in the process, resulting in a thinner, weaker diaphragm structure. This weakness may be particularly problematic in the cylindrical or "neck" region of a loudspeaker cone structure, where the voice coil is attached to the diaphragm because maximum stress is placed upon the structure of the cone in this area. Some loudspeaker diaphragms include a thicker aluminum substrate for the diaphragm structure. Use of a thicker substrate, however, increases the overall mass of the cone and may adversely affect the acoustic performance of the cone.

In the anodizing process, the aluminum work-piece that forms the diaphragm becomes the anode in an electrochemical cell that also contains a cathode and an electrolyte. When a current is passed through the cell, an aluminum oxide layer is formed on the aluminum work-piece. Conventional anodizing processes may operate at current densities of one to three $A/dm^2$ of metal surface. At these values, the electrical impedance of the anode/cathode interface is significantly higher than that of the electrolyte between anode and cathode. This impedance increases with the increase in coating thickness. Thus, any area of the anode that is more thinly coated will present less impedance to current flow. Consequently, the current density in that area will be higher, causing the rate of formation of oxide to rise until the coating thickness matches that of the remainder of the work-piece. Thus, anodizing processes at these values may be self-leveling and may produce coatings that are substantially uniform in thickness.

Formation of coatings of non-uniform thicknesses may be useful in the manufacture of loudspeaker diaphragms and, in particular, in the manufacture of loudspeaker cones. A thicker coating may be formed in the conical region of the diaphragm and thinner coating may be formed in the cylindrical region of the diaphragm. Formation of such non-uniform layers involves carrying out the coating formation process in two separate steps. For example, a cone is anodized to form a thin coating in the cylindrical or neck area of the cone. The cylindrical or neck area of the cone then may be masked by an application of a suitable lacquer, wax, or mechanical contact masking device to the area where a thinner layer is desired. The unmasked area of the cone is then further anodized until that area is coated to the desired thickness. Thus, the cylindrical area is less thickly coated than the conical area of the cone with a "step" at the junction or transition region between the two coating thickness, which may act as a stress raiser to cause fatigue failure of the cone in service.

Therefore, there exists a need for loudspeaker diaphragms having a continuous coating of variable thickness, greater structural integrity, and improved performance that can be efficiently and economically mass-produced.

SUMMARY

This invention provides loudspeaker diaphragms and, in particular, loudspeaker cones, having a continuous coating of variable thickness. In particular, this invention relates to loudspeaker diaphragms including a continuous coating of non-uniform thickness formed in a single coating forming step. As used in this application, loudspeaker diaphragm refers to any loudspeaker diaphragm shape including loudspeaker cones.

Loudspeaker diaphragms include a conical region and a cylindrical region. The diaphragm includes a continuous, non-uniform coating formed on its surface. The coating may be thicker in one region of the diaphragm than in another region of the diaphragm and taper from a maximum value in one region of the diaphragm to a minimum value in another region of the diaphragm. A continuous coating of variable thickness may be formed on either or both of the inner and outer surfaces of the conical and cylindrical portions of the diaphragm. Coatings formed on both inner and outer surfaces of the diaphragm may be of the same configuration, thicknesses, and taper, or they may be different.

The coating may be an oxide layer that has been anodically formed onto one or more surfaces of the diaphragm. Many different types of non-uniform coatings are possible. For example, the coating may continuously taper from the periphery of the conical region through the cylindrical region. The coating may taper from a point on the surface of the conical region to a point on the surface of the cylindrical region, such as the area of transition from the conical region to the cylindrical region of the diaphragm. The coating also may be tapered in the conical region and uniform in the cylindrical region. In addition, the portion of the coating on the surface of the conical region may include one area of uniform thickness and a tapered area, and the portion of the coating on the surface of the cylindrical region may be either of a uniform thickness or tapered.

In order to form the anodized coating, the loudspeaker diaphragm is connected as the anode of an electrochemical cell having at least one cathode and an electrolyte. A non-contact mask constructed of an insulating material may be positioned between the cathode and the surface of the diaphragm to be anodized. An electrolyte, such as sulphuric acid, or other suitable electrolyte, is introduced into the cell. A current is passed through the cell forming a coating on the surface of the diaphragm. The cell may be operated at high current densities and varying temperatures. For example, the cell may be operated at current densities between about 10 $A/dm^2$ and 300 $A/dm^2$, and temperatures of 0 to 100 degrees C. The current density distribution at the anode/electrolyte interface may be controlled to achieve a continuous coating of varying thicknesses.

The current density distribution at the anode/electrolyte interface may be controlled by varying the electrical impedance between the cathode and the respective areas of the diaphragm to be coated such that any area having higher impedance will carry less current than an area having less impedance. Electrical impedance and, therefore, current density distribution may be controlled by varying the path length of the electrical current through the electrolyte between the cathode and the anode, or by varying the cross-sectional area of the current path length, or any combination thereof.

Formation of the non-uniform coating does not require any part of the loudspeaker diaphragm to be coated be physically masked, a change in voltage or current, the use of different electrolytes, or an interruption in the coating process. No area of weakness may be formed at the junction between the areas of different thicknesses, and the coating may be formed in a single step without interruption of the process and without the need to adjust a contact mask, thus permitting the efficient and economical mass production of speaker diaphragms.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles the invention. Moreover, in the figures, like referenced numerals designate corresponding parts throughout the different

DETAILED DESCRIPTION OF THE PREFERRED EMBODIMENTS

This invention relates to loudspeaker diaphragms to which a coating of variable thickness has been applied. In particular, this invention includes loudspeaker diaphragms having a continuous coating that tapers from a first thickness in one region of the diaphragm to a second thickness in a second region of the diaphragm. The coating increases the stiffness of the diaphragm, causing an upward shift in the frequency of the diaphragm's characteristic resonances, thus extending the usable bandwidth of the loudspeaker with consequent improvement in its acoustic performance. The coating may be formed on the diaphragm as a single continuous layer of variable thickness in a single coating step without interruption of the coating process and without the need for physical contact with the diaphragm surface.

Figure 1:
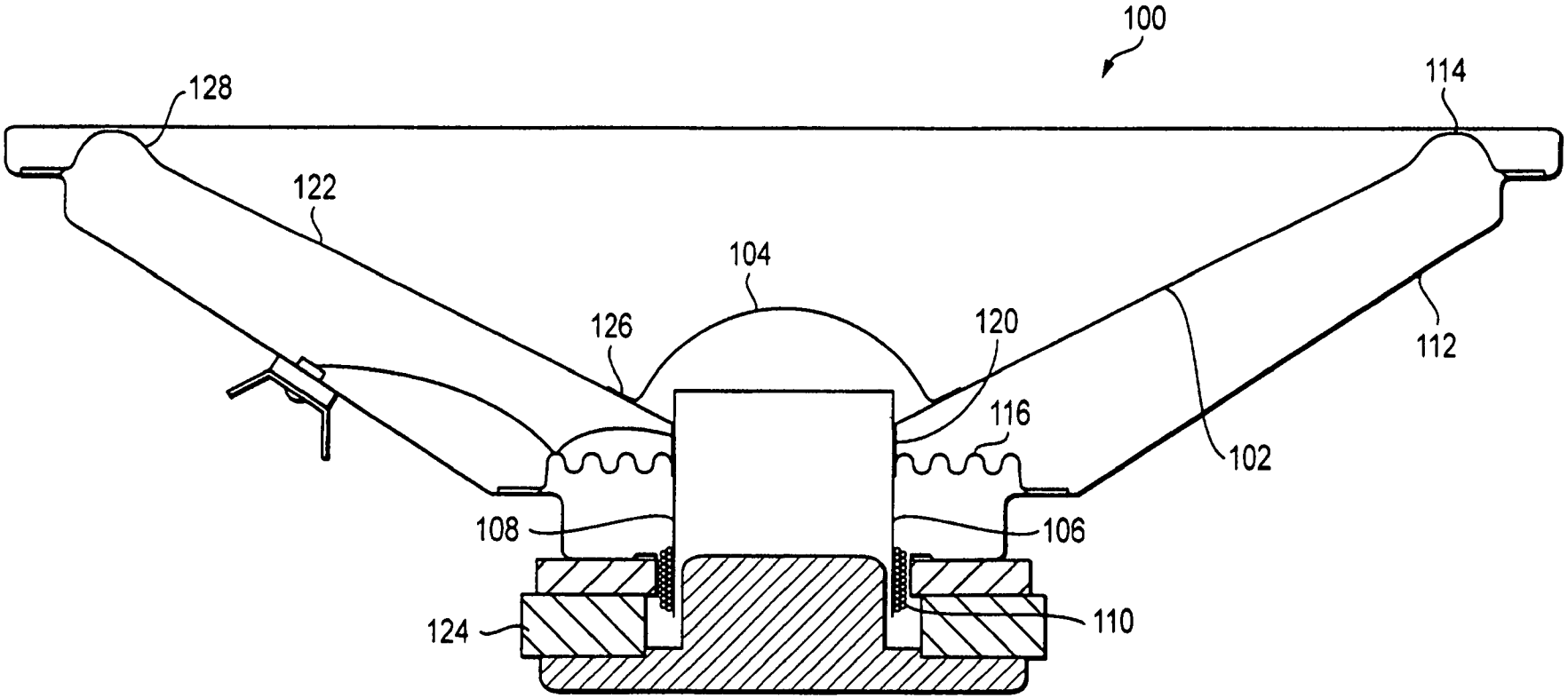
FIG. 1 is a cross-sectional view of a loudspeaker according to the described systems.

FIG. 1 is a cross-sectional diagram of a loudspeaker. The loudspeaker 100 includes a loudspeaker diaphragm 102, a dome 104, and a voice coil 106. The voice coil 106 includes former 108 and windings 110. The loudspeaker diaphragm 102 is held within a chassis 112 by a suspension system provided by surround 114 and spider 116.

Figure 2:
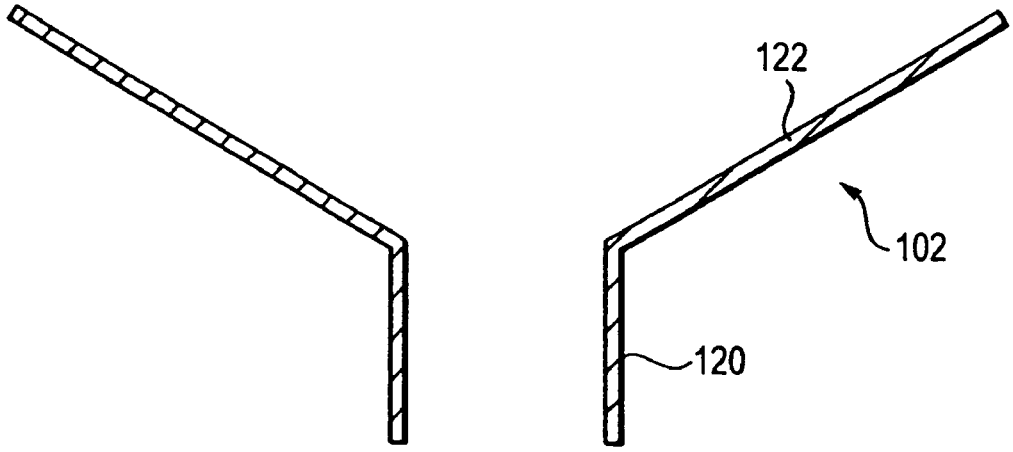
FIG. 2 is a cross-sectional view of a loudspeaker diaphragm according to the described systems.
Figure 5:
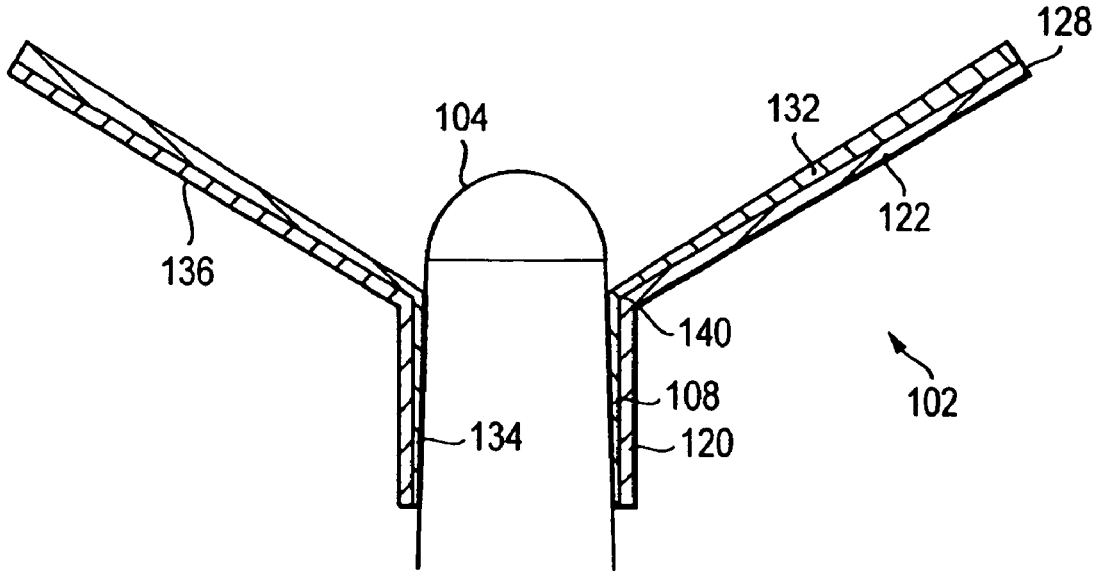
FIG. 5 is a cross-sectional view of a loudspeaker diaphragm including a tapered coating and including a dome attached to the voice coil former.

In FIG. 1, the loudspeaker diaphragm 102 comprises a loudspeaker cone. The loudspeaker cone includes a neck or generally cylindrical region 120 and a generally conical region 122. The voice coil former 108 may be attached to the cylindrical region 120 and held in place by an adhesive or other means of attachment. Alternatively, dome 104 may be attached to the voice coil former 108 (FIG. 5). FIG. 2 is a cross-sectional diagram of a loudspeaker cone 102 showing a conical region 122 and a cylindrical region 120.

In FIG. 1, the voice coil windings 110 may be positioned within a magnetic field provided by a magnetic system 124. When alternating current is passed through the voice coil windings 110, the voice coil 106 moves back and forth in the magnetic field, thus causing loudspeaker cone 112 to vibrate at the frequency of the alternating current and emit sounds. Surround 114 and spider 116 permit the loudspeaker cone 102 to move in both positive and negative directions within a finite excursion over a limited frequency range.

In FIG. 1, the region of the loudspeaker diaphragm 102 that is primarily responsible for the emission of sound from the loudspeaker 100, is known as the acoustic region of the diaphragm 102. This region may include the conical region 122 of the diaphragm between the point of attachment 126 of the dome 104 and the periphery 128 of the diaphragm 102. Where the dome 104 is attached to the voice coil former 108, the acoustic region may extend across the entire area of the conical region 122.

The loudspeaker diaphragm 102 may be formed of any suitable material, such as anodizable materials, including aluminum, titanium, magnesium, alloys of aluminum, alloys of titanium, alloys of magnesium, or any combinations thereof. The surface of the conical region 122 and cylindrical region 120 of the loudspeaker diaphragm 102 may be provided with a coating. In a loudspeaker diaphragm where the dome 104 is attached to the conical region 122, the dome 104 may also include a coating. The coating on the surfaces of the diaphragm is formed as a continuous coating and there is no "step" between any of the portions of the coating having different thicknesses. For example, the coating includes a continuous coating from the periphery 128 of the conical section 122 of the diaphragm through the cylindrical portion 120 of the diaphragm. During anodization, a non-uniform, continuous coating is formed in a single step with out the use of contact masking.

The method provides for the formation of a coating on a loudspeaker diaphragm that is thicker in one region of the diaphragm than another region of the diaphragm and tapers from one maximum value at one point on the diaphragm surface to a minimum value at another point on diaphragm surface. Any suitable coating technique may be employed to form a non-uniform, continuous coating on the surface of the diaphragm.

The coating may be formed of any suitable material including carbide, boride, nitride or oxide. Where the diaphragm 102 is of an anodizable material, the coating may be formed of an oxide layer. An oxide coating may be formed on the surface of the diaphragm by an anodic oxidation process. For example, the coating may be formed by the Keronite process.

Formation of the non-uniform, continuous coating by anodization employs an electrochemical cell including an electrolyte and a cathode. The diaphragm to be coated is connected as the anode of the electrochemical cell. The cathode of the cell may be formed of aluminum, lead, stainless steel, or other materials known for such use. Any suitable electrolyte may be used, including acids such as sulphuric acid, oxalic acid, phosphoric acid, acid mixtures or mixtures of acids and salts. When sulphuric acid is used, the electrolyte concentration may be from about 100 μl to about 400 g/l sulphuric acid and from about 1 g/l to about 30 g/l aluminum. In one example, the electrolyte concentration may be from about 200 g/l to about 300 μl sulphuric acid and from about 2 g/l to about 20 g/l aluminum. The cell may be operated at electrolyte temperatures from about 0 to about 100 degrees Celsius. The electrolyte may be heated to a temperature greater than room temperature, for example from about 30 to about 80 degrees Celsius. By way of further example, the electrolyte may be heated to a temperature of from 40 to 60 degrees Celsius. In another example, the electrolyte may be heated to a temperature of from 45 to 55 degrees Celsius. Increasing the temperature may contribute to an increase in the impedance of the electrolyte relative to the impedance of the electrolyte/anode interface.

During anodization, a current passes through the cell and the electrolyte passes over the surface of the loudspeaker diaphragm to form an oxide layer on the loudspeaker diaphragm. Passing the electrolyte over the substrate removes heat generated by the process away from the surface of the substrate. The electrolyte is pumped through the electrochemical cell via an inlet and outlet in the electrolyte cell. The electrolyte may be passed over the surface of the diaphragm at a velocity of from about 10 to 1000 meters/minute. For example, the electrolyte may be passed over the surface of the diaphragm at a velocity of from about 100 to 200 meters/minute. In another example, the electrolyte is passed over the substrate at a velocity of about 120 meters/minute.

The current density distribution within the cell is controlled such that the oxide layer may be formed more rapidly on one region of the diaphragm than another region of the diaphragm. The cell be operated at current densities that are higher than those conventionally employed in anodizing processes, such as current densities of at least 5 $A/dm^2$, for example, from about 10 $A/dm^2$ to about 300 $A/dm^2$. The cell may be operated at an average current density of from about 60 $A/dm^2$ to about 200 $A/dm^2$. In one example, the cell may be operated at an average current density of from about 80 $A/dm^2$ to about 150 $A/dm^2$. In another example, the cell may be operated at an average current density of from about 90 $A/dm^2$ to about 100 $A/dm^2$.

By operating the cell at densities higher than those conventionally employed, the voltage drop within the electrolyte may be increased with respect to that the electrolyte/anode interface. Thus, the current density at the surface of the anode varies, depending on the current path length between the anode and cathode, in relation to its cross-sectional area. Current path length is the distance a charge has to travel from the cathode to reach a particular region of the anode. In general, the greater the distance between the cathode and the anode, the greater the current path length. The current density along the substrate may be greatest where the current path length is at a minimum and smallest where the current path length is at a maximum. Thus, when a cell is operated at current densities higher than those conventionally employed the current density across the anode substrate may be controlled by varying the current path length between the cathode and various regions of the anode substrate. Oxide layers form most rapidly in regions where local current density is high and least rapidly where the local current density is low. Thus, in a given time frame, the thickness of the oxide layer will vary across the substrate.

A non-contact mask may be positioned between the cathode and the substrate to be anodized to vary the current path length between the cathode and the anode substrate. A non-contact mask is one that does not come into physical contact with the substrate to be anodized. In this way, the current density of the region of the anode substrate that is shielded by the mask may be reduced resulting in a corresponding decrease in the rate of oxide formed in the region. By varying the size, shape, geometry, position, and/or composition of the non-contact mask, the variation of the thickness in the oxide layer may selectively be controlled.

The mask may be formed of any suitable insulating material. For example, the mask may be formed of an insulating polymeric material such as polypropylene. The mask may include a metal or other electrically conductive material. The electrically conductive portion of the mask may be coupled to the cathode. The electrically conductive material acts to modify the current distribution and vary the distribution of coating thicknesses.

The distance between the mask and the substrate to be anodized may be from about 0.1 mm to about 20 mm. For example, the distance between the mask and the substrate to be anodized may be from about 0.1 mm to about 5 mm. The distance between the between the mask and the substrate to be anodized may be dependent on various factors, including the size and shape of the substrate. The shape of the mask may also be dependent upon the shape of the substrate. Where the substrate to be anodized is a loudspeaker cone, the shape of the mask may be correspondingly conical.

When used to produce an oxide layer on the surface of a cone-shaped loudspeaker diaphragm, the formation of the oxide coating on the diaphragm may be variably controlled to produce a single continuous coating of varying thicknesses and tapered regions as more fully described below. The coating may be formed on either or both surfaces of the diaphragm.

Where a coating is formed on both the inner and outer surfaces of the diaphragm, each coating may be formed separately by connecting separate power supplies each to the inner and outer surfaces of the diaphragm. For example, one power supply may be coupled to the inner surface and cathode and a second power supply may be coupled to the outer surface and different cathode. By operating the two cells at different current densities, the coatings on the inner and outer layers can be varied independently. Alternatively, both cells may be operated under identical conditions. Use of separate cathodes and power supplies for each of the inner and outer surfaces may be used to improve control of the formation of the coating on those surfaces.

The coating on both the inner and outer surfaces of the diaphragm also may be formed in a single anodizing step. A cell employing a single cathode, a single power supply, and two or more masks may be used to accomplish anodization of both layers. By using differently configured masks or by differently positioning the masks, the inner and out layers also may be varied.

Figure 3:
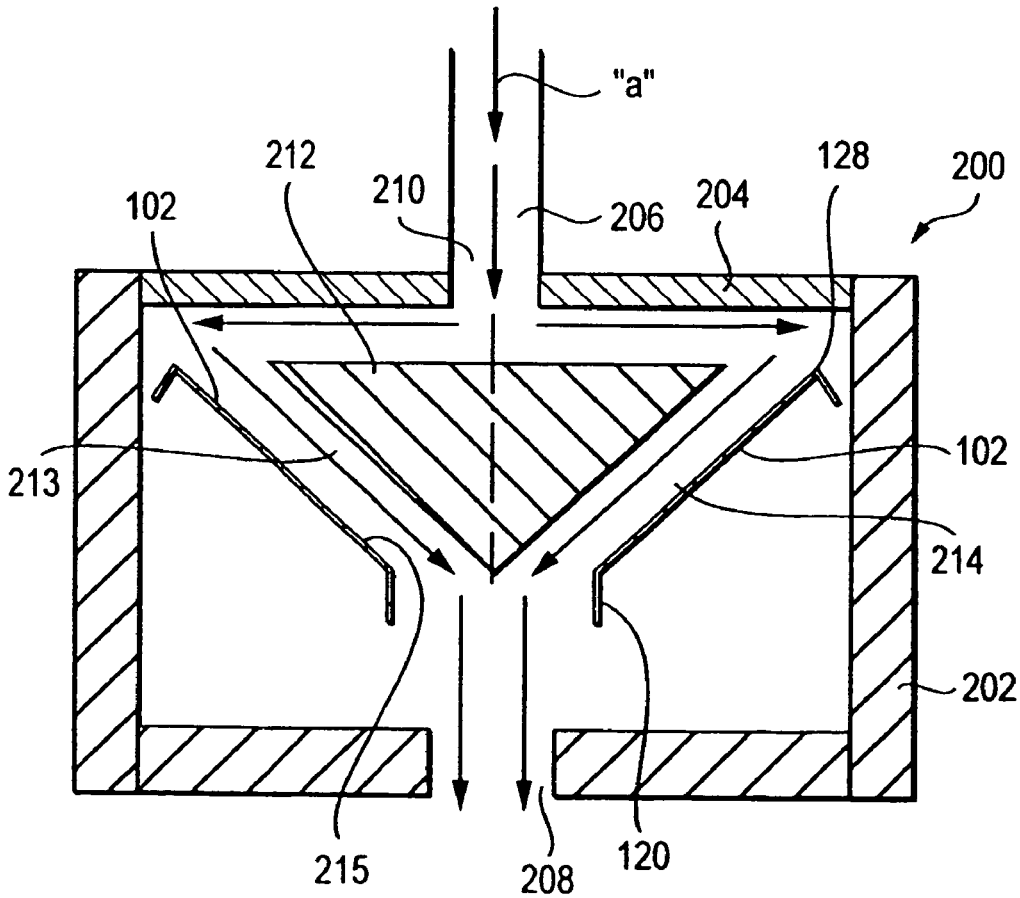
FIG. 3 depicts an electrochemical cell including a mask and a loudspeaker diaphragm.

FIG. 3 illustrates an apparatus for forming a continuous, non-uniform layer on a substrate, and in particular, a loudspeaker diaphragm 102. Apparatus 200 includes a casing 202, cathode 204, inlet 206 and outlet 208. The substrate, loudspeaker diaphragm 102, is employed as the anode. The apparatus 200 is provided with an electrolyte 210. Mask 212 is positioned in a spaced, non-contacting relation to the surface of the diaphragm 102. As illustrated, mask 212 is conical in shape, however, other shapes are suitable as well depending on the shape of the substrate and the desired thickness of the coating, for example.

The electrolyte 210 may be pumped through the apparatus 200 via inlet 206 and outlet 208. The electrolyte flows through channels 213 and 214 defined by mask 212 and the diaphragm inner surface 215 as indicated by arrows "a." The electrolyte may flow over the inner surface 215 of the diaphragm 102. A power supply (not shown) may be connected to the cathode 204 and the inner surface 215 of the diaphragm 102, which form the cathode and the anode of an electrochemical cell. The cell may be operated at a selected current density and temperature as described above. For example, the cell may be operated at an average current density of 90 $A/dm^2$ and a temperature of about 45 to 55 degrees Celsius. The voltage drop within the electrolyte 210 is greater than that at the electrolyte/anode (diaphragm) interface. Thus, depending on the current path length between the cathode 204 and the inner diaphragm surface 215, the current density along the diaphragm 102 may vary.

Because of the relative size, geometry, and location of the mask 212, the distance between the cathode 204 and the inner surface 215 of the diaphragm 102 tapers from a minimum at the periphery 128 of the conical region 120 of the diaphragm 102 to a maximum at the neck or cylindrical region 120 of the diaphragm 102. The current path length tapers in a corresponding manner. Accordingly, the local current density at the inner surface 215 of the diaphragm 102 tapers in reverse, i.e., from a maximum at the periphery 128 to a minimum at the neck or cylindrical region 120. As the rate of formation of the coating is highest where the local density is at a maximum, the rate of coating formation tapers from a maximum at the periphery 128 to a minimum at the neck or cylindrical region 120. Coated loudspeaker diaphragms produced by this process are illustrated in FIGS. 4-7.

Figure 4:
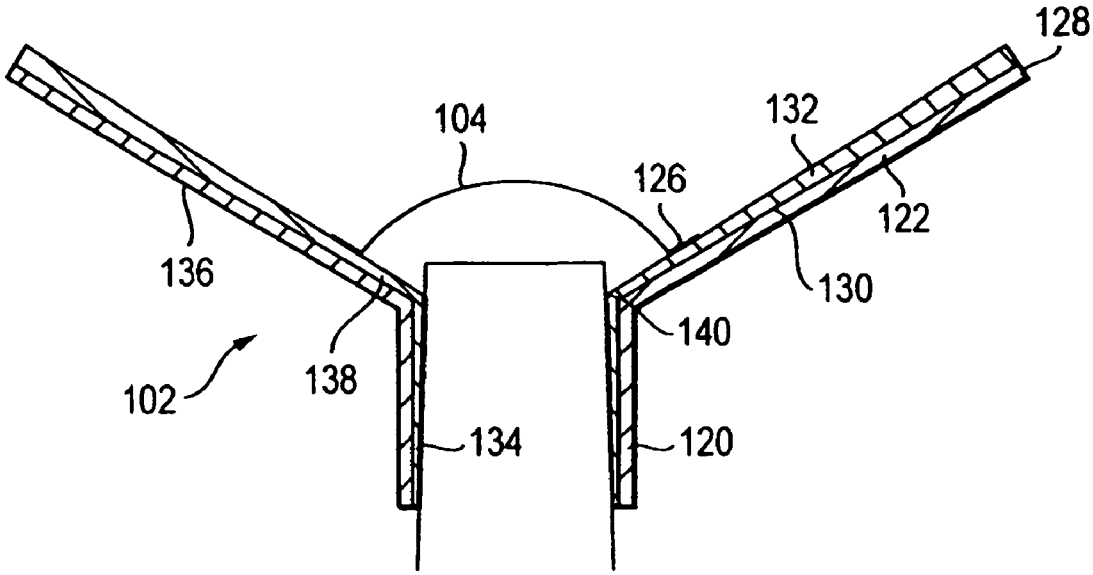
FIG. 4 is a cross-sectional view of a loudspeaker diaphragm including a tapered coating and including a dome connected to the diaphragm.
Figure 6:
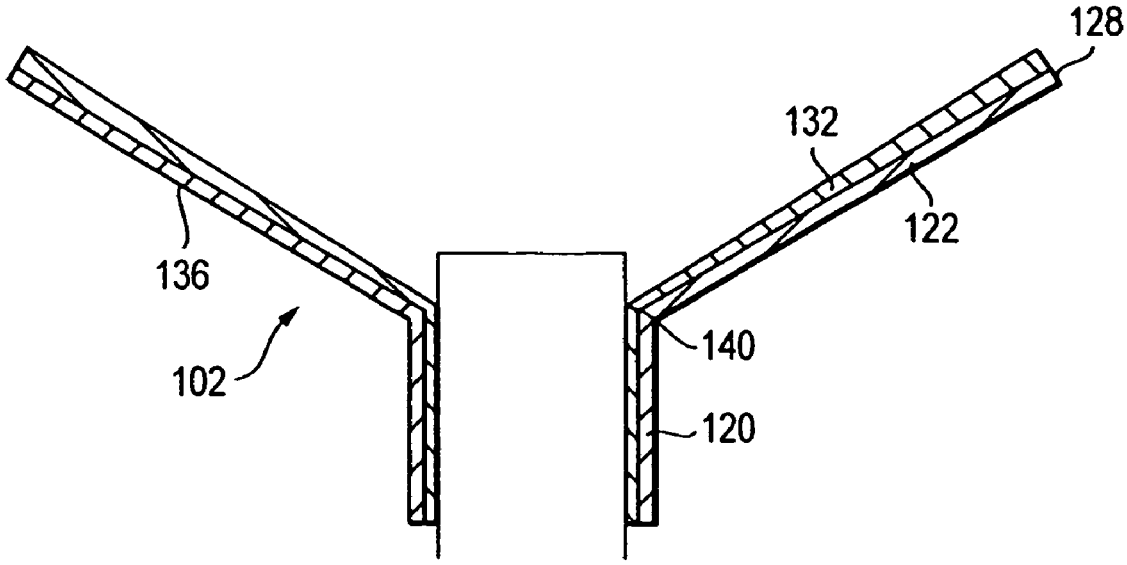
FIG. 6 is a cross-sectional view of a loudspeaker diaphragm including a tapered coating in the conical portion of the diaphragm and a uniform coating in the cylindrical portion.
Figure 7:
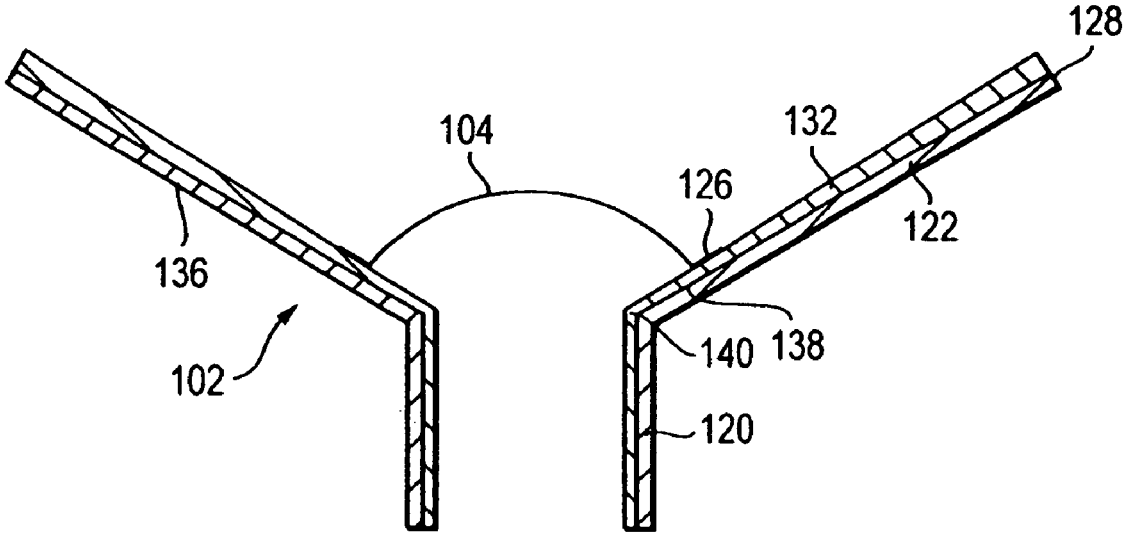
FIG. 7 is a cross-sectional view of a loudspeaker diaphragm including a tapered coating in the conical portion of the diaphragm and a uniform coating in the cylindrical portion and further including a dome.

FIGS. 4-7 illustrate various coatings 132 formed on the surface of the loudspeaker diaphragm. As shown in FIGS. 4-7, the inner surface 130 of the diaphragm 102 may be provided with a coating 132. In FIGS. 4 and 7, a dome 104 is attached to the coating 132 surface in the conical region 122. In FIG. 5, the dome 104 is attached to the voice coil former 108. FIGS. 4-5 show a coating 132 on the inner surface 130 of the diaphragm 102 that tapers from a maximum thickness at the periphery 128 of the conical region 122 of the diaphragm 102 to a minimum thickness in the neck or cylindrical region 120 of the diaphragm 102. The coating 132 may be minimal in the cylindrical region 122 and may be tapered or uniform. In FIGS. 4-5, the coating 134 in the cylindrical region 122 is tapered. As in FIG. 5, the portion of the coating 134 on the surface of the cylindrical region 120 may be thinner than, relative to at least part of, a portion of the coating on the conical region 122.

FIGS. 6 and 7 show a coating 132 on the inner surface 130 of the diaphragm 102 that tapers from a maximum thickness at the periphery 128 of the conical region 122 of the diaphragm 102 to a minimum thickness at the neck or cylindrical region 120 of the diaphragm 102. FIGS. 6-7 show a coating of substantially uniform thickness in the cylindrical region 122.

Figure 8:
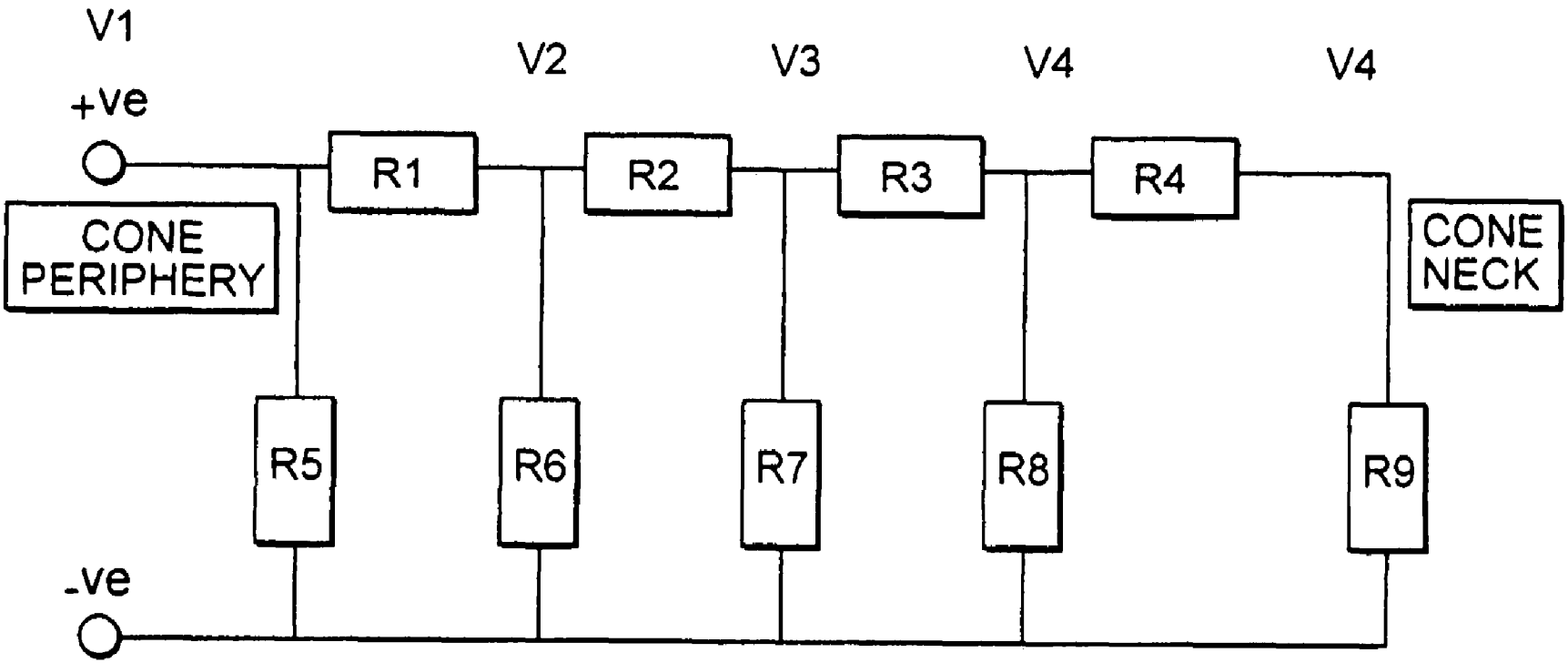
FIG. 8 is a circuit diagram of an anodizing cell.

As the rate of formation of the coating is highest where the local density is at a maximum, the rate of coating formation tapers from a maximum at the periphery 128 to a minimum at the neck or cylindrical region 120. This is demonstrated in the circuit diagram at FIG. 8. In FIG. 8, R1-R4 represent the impedance of an electrolyte between selected points from the periphery to the center of the substrate. R5-R9 represent the impedance across intermediate points. As current flows through every element of the system, the voltage drop across R1-R4 results in a progressive reduction in voltage (V1>V2>V3>V4>V5) across R5-R9, causing a reduction in current density with increasing distance from V1 and a corresponding progressive reduction in coating thickness from R5 to R9.

Figure 9:
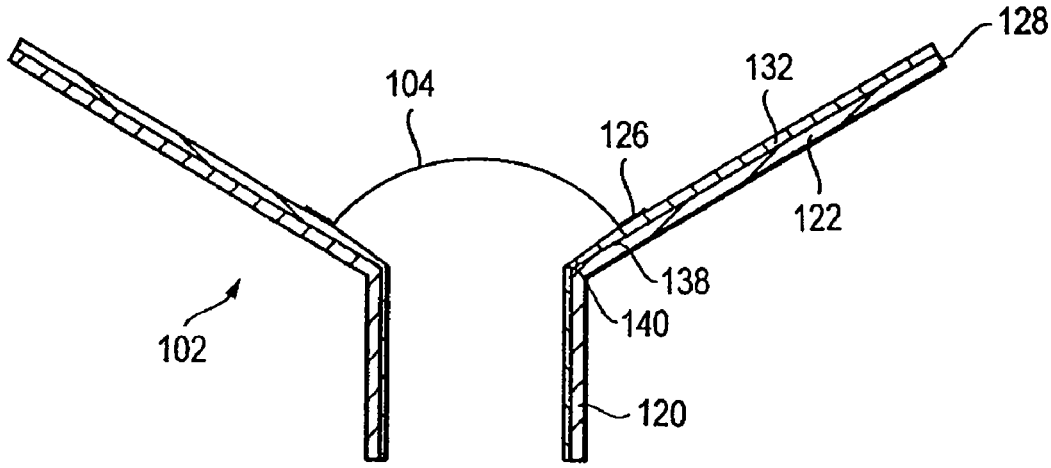
FIG. 9 is a cross-sectional view of a loudspeaker diaphragm including a coating of differing thicknesses the conical region inward and outward of the dome.

In FIG. 9, where the dome 104 is attached to the surface of the coating 132 in the conical region 122 of the diaphragm 102, the region 138 of the coating between the point of attachment 126 of the dome 104 to the conical region 122 and the junction 140 of the conical region 122 and the cylindrical region 120 may be thinner than the portion of the coating outward of the point of attachment 126. The region 138 of the coating between the point of attachment 126 of the dome 104 to the conical region 122 and the junction 140 of the conical region 122 and the cylindrical region 120 may include a gradual or slight taper. A thinner or tapered coating in this region 138 may help to improve the structure integrity of the diaphragm 102.

Figure 10:
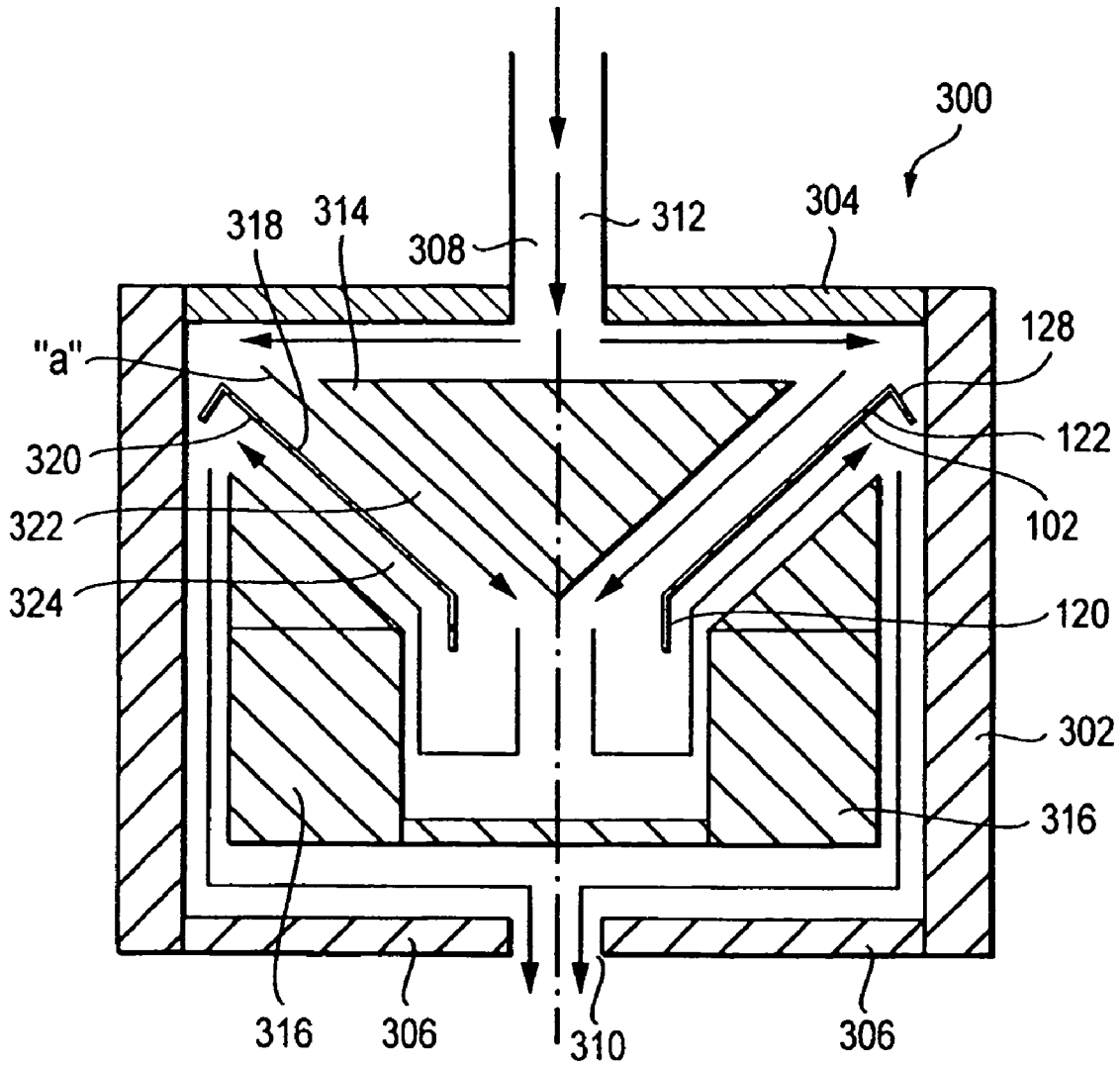
FIG. 10 depicts an electrochemical cell including two masks, two cathodes, and a loudspeaker diaphragm.

FIG. 10 depicts an apparatus for forming a continuous, non-uniform layer on both surfaces of a substrate, and in particular the inner and outer surfaces 318, 320 of a loudspeaker diaphragm. Apparatus 300 includes a casing 302, cathodes 304 and 306, inlet 308 and outlet 310. The substrate, loudspeaker diaphragm 102, is employed as the anode. The apparatus 300 is provided with an electrolyte 312. Masks 314 and 316 are positioned in a spaced, non-contacting relation to the inner 318 surface and the outer surface 320 of the diaphragm 102. In operation, electrolyte 312 is pumped into the apparatus 300 via inlet 308 and outlet 310. The electrolyte 312 flows through channels 322 and 324 defined by masks 314 and 316 and over the diaphragm inner surface 318 and outer surface 320 as indicated by arrows "a." The electrolyte 312 flows over both the inner 318 and outer 320 surfaces of the diaphragm 102. One or more power supplies (not shown) may be connected to the cathodes 304 and 306 and inner 318 and outer 320 surfaces of the diaphragm 102, each which form the cathode and the anode of an electrochemical cell. The cell may be operated at a selected current density and temperature as described above. For example, the cell may be operated at an average current density of 90 A/dm$^2$ and a temperature of about 45 to 55 degrees Celsius. The voltage drop within the electrolyte is greater than that at the electrolyte/anode (diaphragm) interface. Thus, depending on the current path length between the cathodes and the diaphragm surfaces, the density along the diaphragm varies.

Because of the relative size, geometry, and location of the masks 314, the distance between the cathode 304 and the inner surface 318 of the diaphragm 312 tapers from a minimum at the periphery 128 of the conical region 122 of the diaphragm 102 to a maximum at the neck or cylindrical region 120 of the diaphragm 102. The current path length tapers in a corresponding manner. Accordingly, the local current density at the inner surface 318 of the diaphragm 102 tapers in reverse, i.e., from a maximum at the periphery 128 to a minimum at the neck or cylindrical region 120.

The second electrochemical cell (as shown in FIG. 10) may be operated at the same current or different density as the first cell. Because of the relative position and geometry of the mask 316, the effective distance between the outer surface 320 of the diaphragm 102 and the cathode 306 may taper from a minimum at the periphery 128 of the conical region 122 of the diaphragm 102 to a maximum of the neck or cylindrical region 120 of the diaphragm 102. As explained above, the coating forms more rapidly at the periphery 128 than at the neck or cylindrical region 120.

Figure 11:
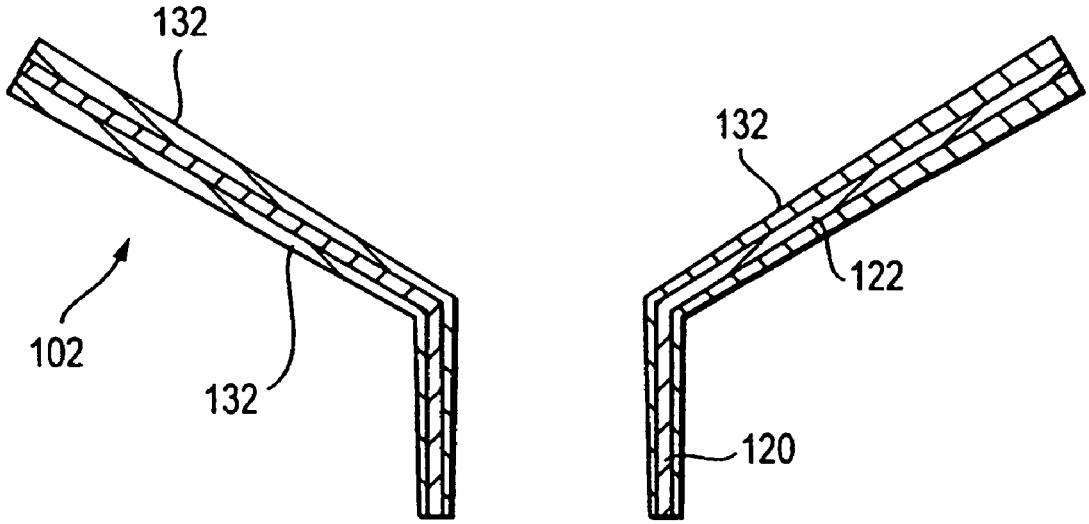
FIG. 11 is a cross-sectional view of a loudspeaker diaphragm including a tapered coating on the inner and outer surfaces of the diaphragm.
Figure 12:
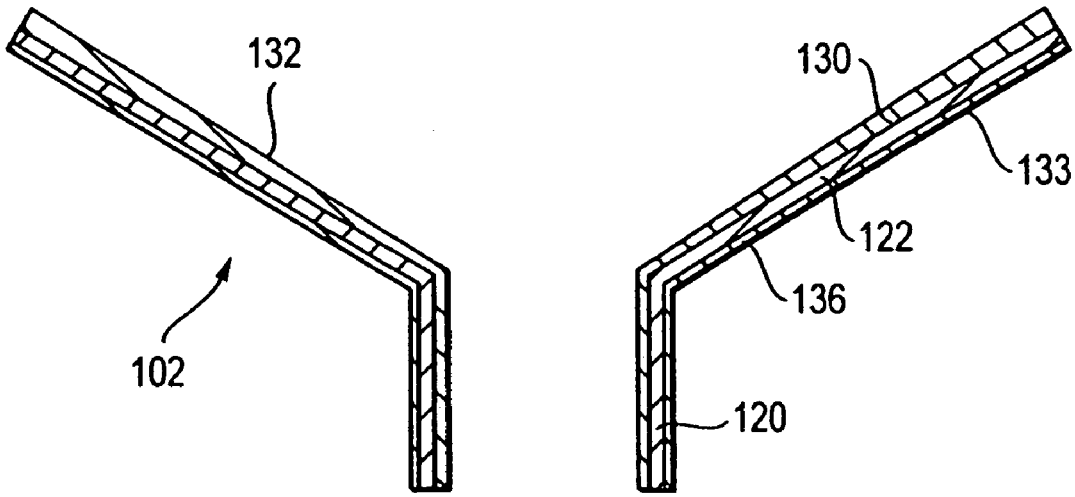
FIG. 12 is a cross-sectional view of a loudspeaker diaphragm having tapered coating on one surface and a uniform coating on the other surface.
Figure 13:
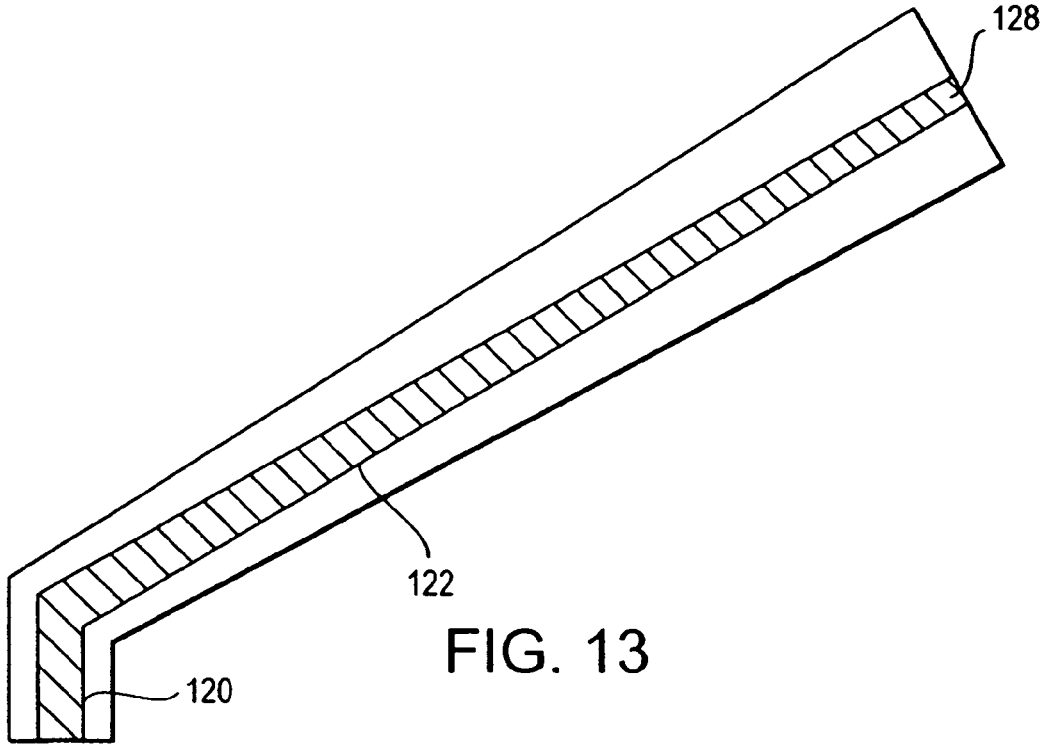
FIG. 13 is a partial cross-sectional view of a loudspeaker diaphragm coated using the electrochemical cell of FIG. 10.

A loudspeaker diaphragm produced by this process and the apparatus of FIG. 10 is illustrated in cross-section in FIGS. 11-13, where the coating on both the inner and outer surfaces of the diaphragm tapers from a maximum thickness at the periphery 128 of the conical region 122 of the diaphragm 102 to a minimum thickness at the neck or cylindrical region 120 of the diaphragm 102. The electrochemical cells may be operated at different current densities to form coatings on the inner and outer surfaces of the diaphragm of differing thicknesses. In FIGS. 11-13, the inner surface 130 and outer surface 136 of both the cylindrical region 120 and conical region 122 may include a continuous coating. As in FIG. 11, the coating on the inner and outer surfaces of the conical region tapers 122 from a maximum thickness at the periphery 128 of the conical region 122 to a minimum value through the transition region or junction of the cylindrical region 120 and the conical region 122 to a uniform thickness in the conical region. In FIG. 12, the coating 132 on the inner surface 130 of the conical region 122 is thicker than the coating 133 on the outer surface 136 of the conical region 122. FIG. 13 depicts a cross-sectional view of a diaphragm 102 where the coating on both surfaces tapers from a maximum value at the periphery to a minimum valued just past the junction 140 of the conical region 122 and the cylindrical region 120.

Figure 15:
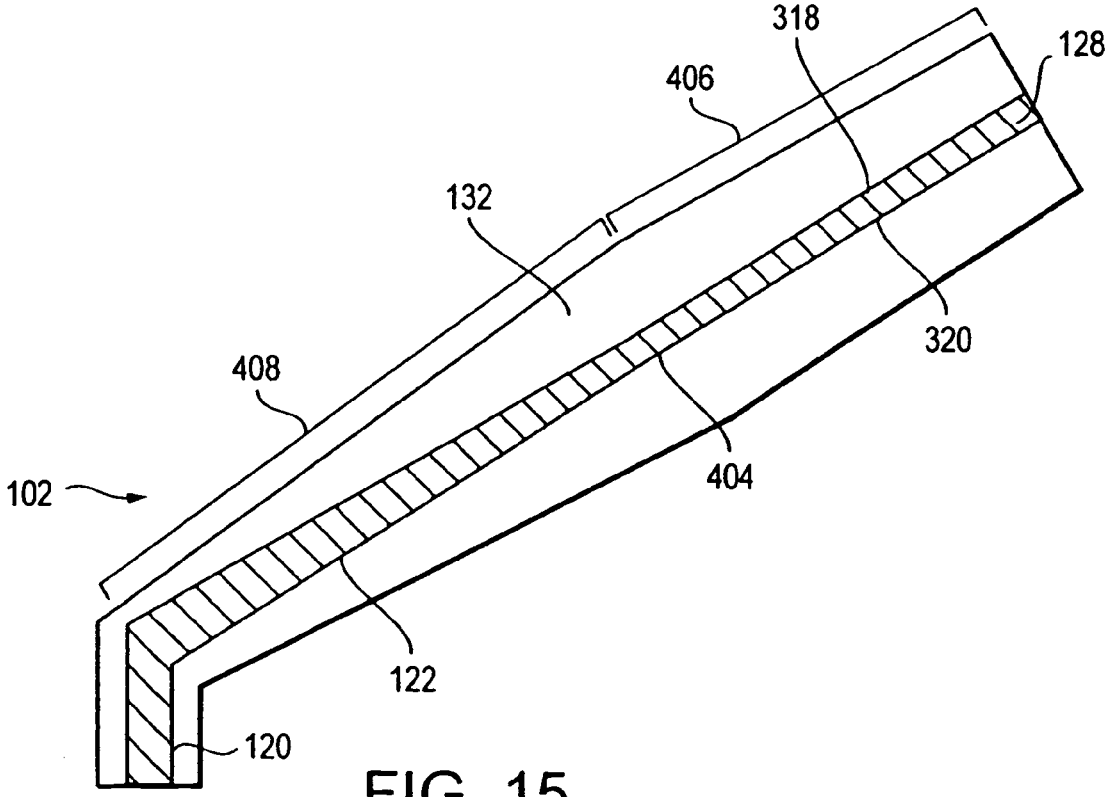
FIG. 15 is a partial cross-sectional view of a loudspeaker diaphragm coated using the apparatus of FIG. 14.
Figure 14:
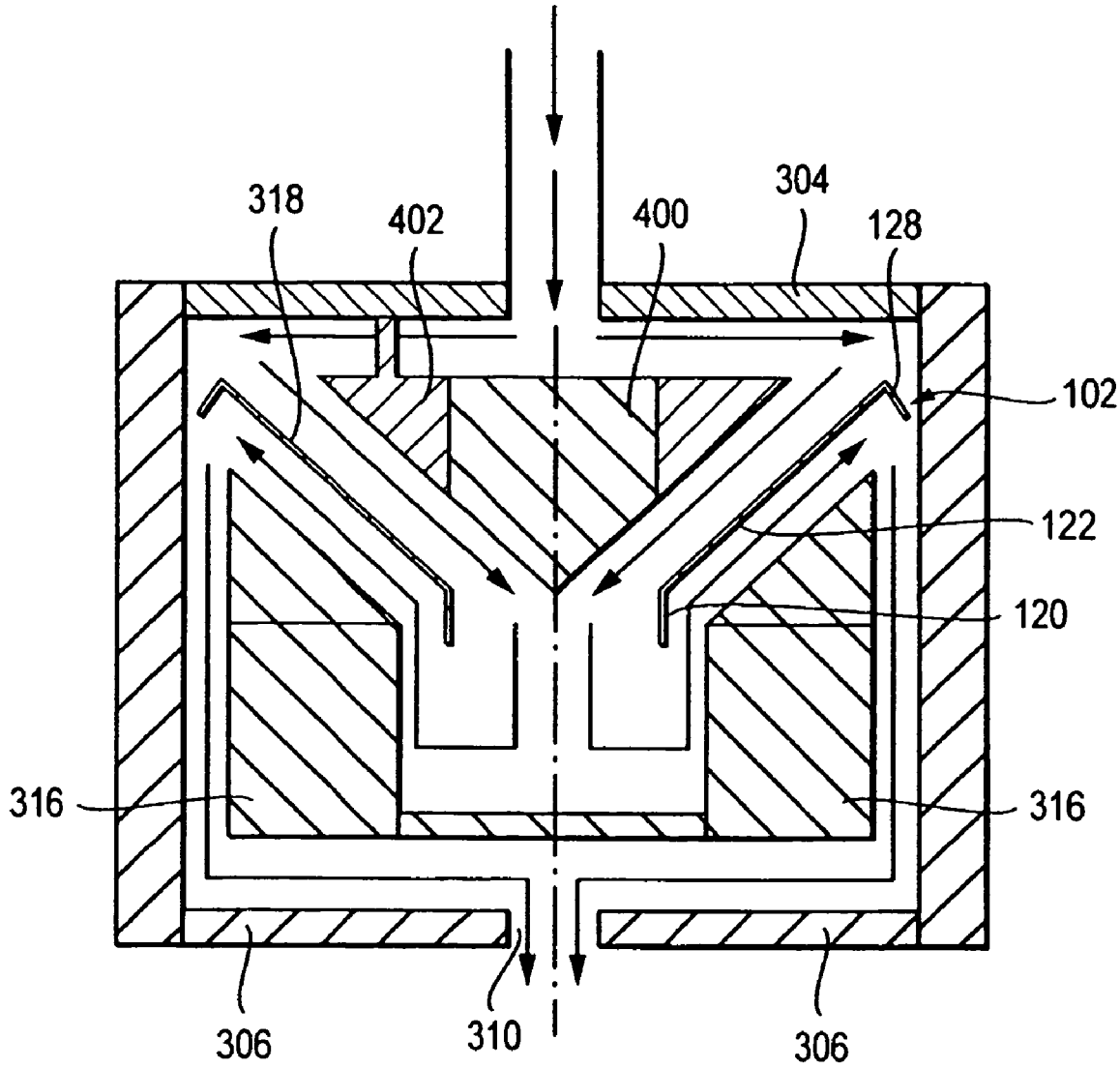
FIG. 14 depicts an electrochemical cell including two masks, two cathodes, and a loudspeaker diaphragm.

FIG. 14 illustrates another mask 400 that may be employed to control the formation of the coating on the inner surface 318 of diaphragm 102. Mask 400 comprises an insulating cone and a conductive metal ring 402 surrounding the cone. The ring 402 may be connected to cathode 304. The ring 402 may be used to distort the relative values of impedance shown in FIG. 8 (by reducing the value of R1) so that a substantially uniformly coated area is produced at the periphery 128 of the diaphragm 102. A conductive material attached to the cathode, such as ring 402, may be applied to any part of the mask to produce a locally thickened area on the diaphragm 102 of substantially uniform thickness. A loudspeaker diaphragm 102 produced by this process is illustrated in cross-section in FIG. 15. The coating 132 on the inner and outer surfaces 318, 320 from the periphery 128 to a point 404 may be a locally thickened area 406 which corresponds to the metal ring in the mask. The thickness of the coating 132 in this area 406 may be uniform. As illustrated, the region of the coating below 408 the uniform region may be tapered.

Figure 16:
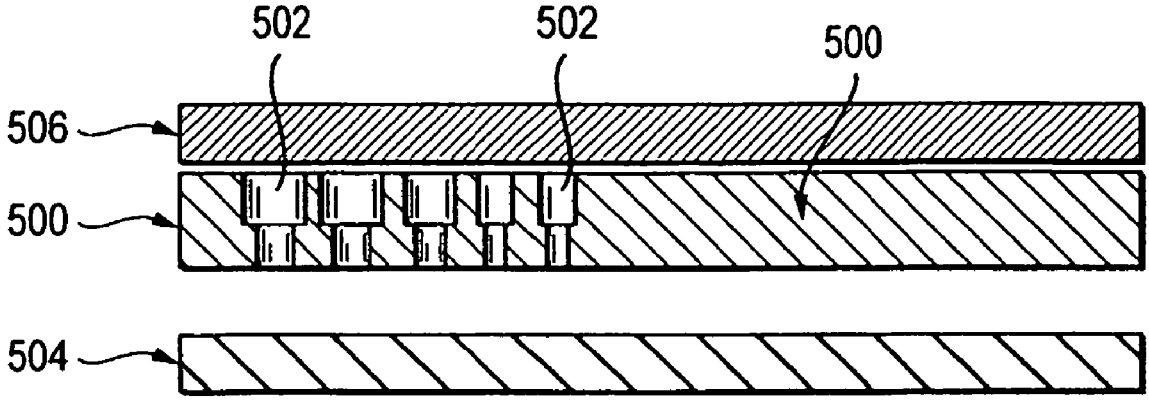
FIG. 16 depicts a partial electrochemical cell including non-contact mask having perforations.

FIG. 16 illustrates another mask 500. Mask 500 has holes or perforations 502 that permit current to pass between the cathode 504 and the anode/substrate 506. Control of the amount of current flow is achieved by the size, shape, depth, and spacing of the holes 502. Small holes have a small cross-sectional area through which the current can flow, thus representing a large value of impedance and consequently a relatively slow growth of coating. Conversely, larger holes, with a larger cross-sectional area possess lower electrical impedance and allow increased current flow and an increased formation of the coating. Similarly, a thick mask (having deeper holes) will provide a relatively long path for the current to flow, resulting in relatively high impedance and thinner coating. Control of the position of the areas of variable coating is achieved by positioning the appropriately sized holes in the areas requiring thicker or thinner coating. By the type of mask profile, the spacing of the mask and the spacing of the holes, gradations in the coating thickness may be achieved.

The coating may be formed on both inner and outer surfaces in many variations. For example, the coating on the outer surface may be the same thickness and taper as the coating on the inner surface. The coating on the outer surface may be thicker or thinner, in whole or in part, than the coating on the inner surface. The coating on the inner surface may taper in whole or in part while the coating on the outer surface may be uniform in thickness. In addition, the coating on the inner surface may be uniform and the coating on the outer surface may taper, in whole or in part. Dome 104 may also include a thin coating.

For a coating that is tapered in either or both the conical and cylindrical regions of the loudspeaker diaphragm, the thickness of the coating in the cylindrical region may range from about 0.1 microns to about 8 microns. For example, the thickness may be from about 1 to 4 microns. In another example, the thickness of the coating in the cylindrical region may range from about 2 to about 3 microns. The thickness of the coating in the conical region may range from about 2 to about 100 microns. For example, the thickness may be from about 8 to about 40 microns. In another example, the thickness of the coating in the conical region ranges from about 10 to about 20 microns. The minimum thickness of the coating may be from about 4% to about 25% of the maximum thickness of the coating. For example, the maximum thickness of the coating is from about 9 to 11 microns at the periphery of the conical region and tapers to a minimum thickness from about 1 to about 3 microns in the cylindrical region.

The thickness of the coating may be confirmed by any suitable method, selection of which will depend upon the purpose of the particular measurement. For example, to determine the thickness of the coating over the entire surface of the diaphragm, the diaphragm may be weighed and then stripped of the coating. The coating may be stripped from the diaphragm by any suitable method including by an acid such as a mixture of phosphoric and chromic acid in accordance with British DEF STAN 03-25. The stripped diaphragm is then weighed. The difference between the coated diaphragm and the stripped diaphragm is the weight of the coating. The total surface area of the diaphragm is then calculated. Provided that the density of the coating composition is known, the average thickness of the coating may then be calculated.

The thickness of the coating at any particular point on the diaphragm can be also be calculated by measuring the thickness of the coated diaphragm at the point or points of interest with a micrometer, stripping the coating of the diaphragm as set forth above and then measuring the thickness of the stripped diaphragm. The difference in two thickness measurements is the total thickness of the coating at the point measured. If the diaphragm is coated on both sides, and the coating thicknesses on either side are not the same, the thickness of the coating on either side may be ascertained without reference to the coating on the other side by first masking the surface not to be measured from the stripping solution, so that the difference in micrometer readings is that of the required coating.

Other methods of measuring coating thickness include, but are not limited to, the use of the eddy current method according to BS5411 Pt. 3 and a calibrated microscope focused successively on the surface of coating and that of the underlying metal. As set forth above, the method of measurement selected is dependent upon the purpose of such measurement and certain methods may not be usable in all circumstances In the following examples, substrates were provided with coatings of varying thicknesses. As depicted in the process diagram of FIG. 17, a metal substrate is connected as the anode of an electrochemical cell 700, an electrolyte is pumped into the cell 702 and a current is passed through the cell 704. The current density distribution within the cell may be controlled by varying the current path length of the electrical current 706, and a continuous non-uniform coating forms on the substrate 708. As further depicted in FIG. 18, a non-contact mask is positioned between the cathode and anode\substrate 705.

The examples are exemplary and presented for purposes of illustration only. These examples are not intended in any limiting sense.

EXAMPLE 1

Figure 17:
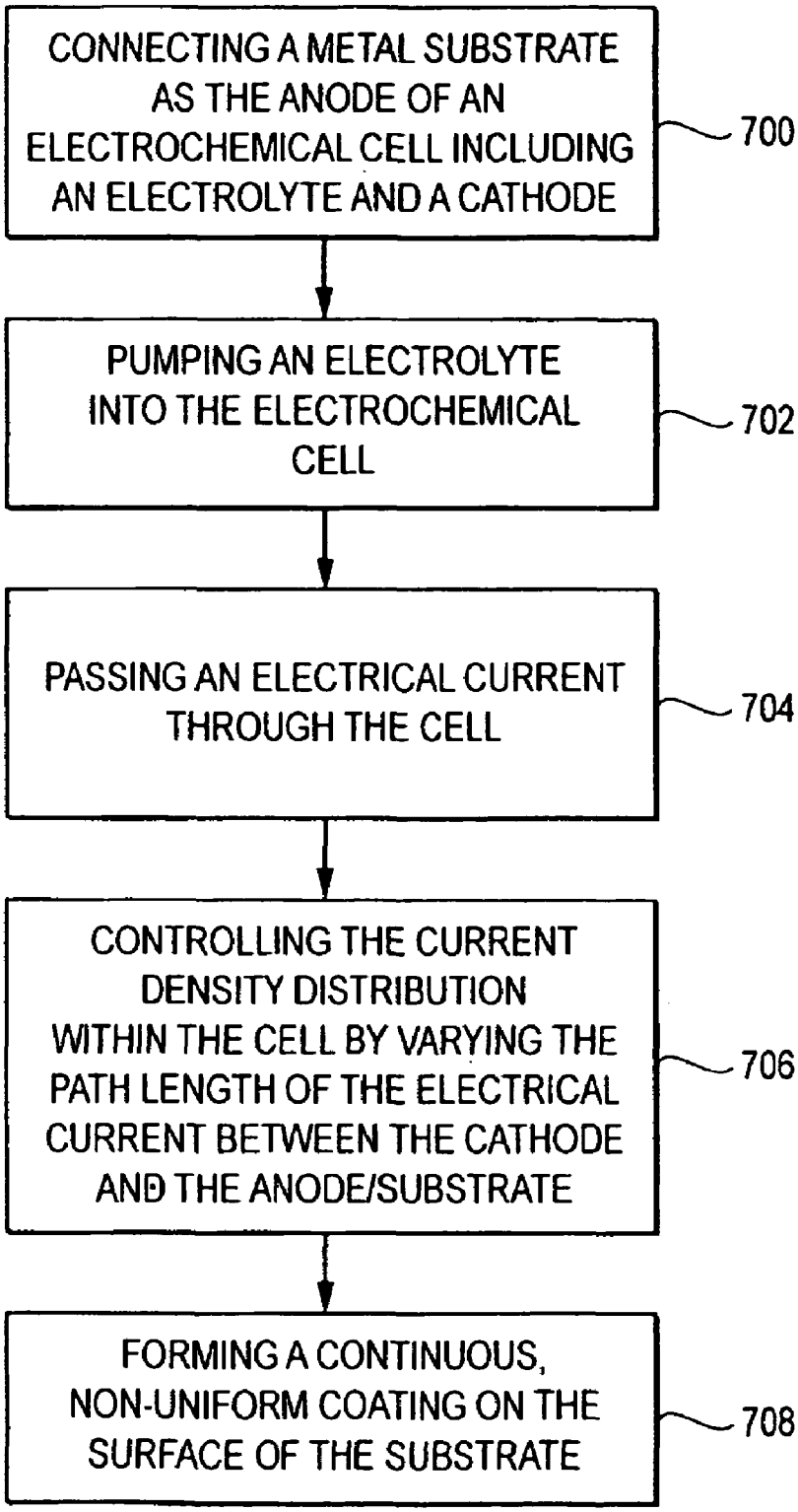
FIG. 17 is a process flow diagram illustrating the operation of an electrochemical cell.
Figure 18:
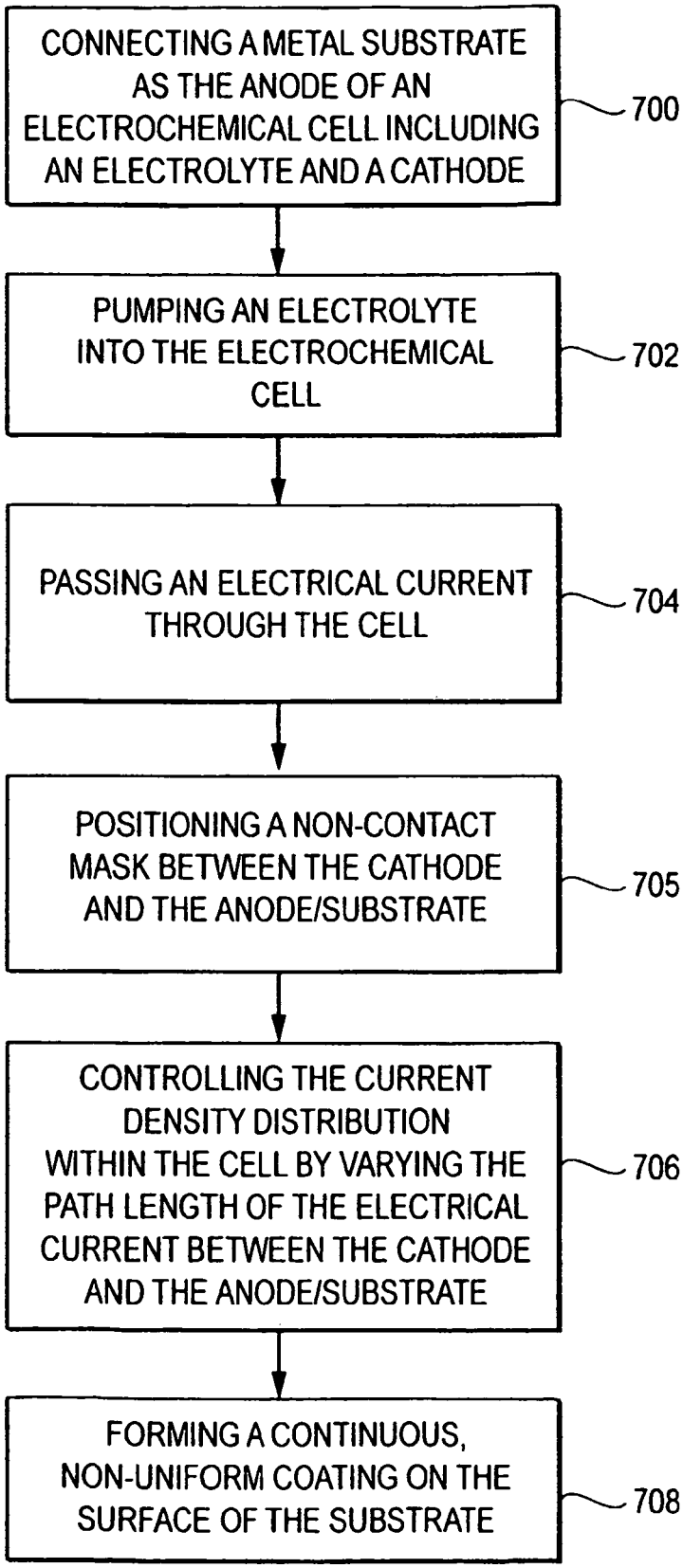
FIG. 18 is a process flow diagram illustrating the operation of an electrochemical cell.

A 100 mm diameter aluminum disk was connected as the anode of a cell illustrated in FIG. 17. A 75 mm polypropylene disk having a central opening of 10 mm was employed as mask. The distance between the mask and the disk substrate was 3 mm. An electrolyte of sulphuric acid at 50 degrees Celsius was pumped into the cell at a rate of 3.0 $m^3$/hour through the central opening of the mask. The aluminum disk was anodized at a current density of 90 A/$dm^2$. After 20 seconds, an oxide coating was formed on the upper surface of the disk. The thickness of the coating tapered from a maximum of 20 microns at the periphery of the disk to a minimum of 2 microns at the center of the disk.

EXAMPLE 2

The procedure of Example 1 was repeated using a 100 mm diameter aluminum disk as the anode. After 20 seconds, an oxide layer was formed on the upper surface of the disk. The oxide layer was uniform in thickness (10 microns) at the periphery of the disk. This uniform region was 15 mm wide. The oxide layer on the remainder of the disk tapered to a minimum value of 2 microns in the central region of the disk.

EXAMPLE 3

The procedure of Examples 1 and 2 were repeated using a mask formed of a 50 mm diameter polypropylene disk immediately surrounded by a 100 mm diameter aluminum ring. The aluminum portion of the mask was connected to the cathode. After 20 seconds, an oxide layer was formed on the upper surface of the disk. The oxide layer at the periphery of the disk had a uniform thickness of 10 microns. This uniform region was 15 mm wide. The oxide layer on the remainder of the disk tapered to a minimum thickness of 2 microns at the center of the disk.

EXAMPLE 4

A 75 mm diameter aluminum cone was connected as the anode of the first electrochemical cell described with reference to FIG. 1. A 65 mm diameter polypropylene cone was employed as mask. The distance between the cone and the mask was kept at 3 mm, but slight variations in distance may have occurred due to the flimsy nature of the cone and turbulent flow of the acid. An electrolyte of the sulfuric acid (50 degrees C.) was pumped into the cell at a rate of 3.0 $m^3$/hour. The aluminum cone was anodized at an average current density of 90 A/$dm^2$. After 20 seconds, an oxide layer was formed on the surfaces of the cone. The thickness of the oxide layer tapered from a maximum of 20 microns at the periphery of the cone to a minimum of 2 microns at the neck (center) of the cone.

EXAMPLE 5

A 75 mm diameter aluminum cone was connected as the anode of the first electrochemical cell described with reference to FIG. 1. The mask was formed of a 65 mm diameter cone having a polypropylene cone portion and a peripheral portion formed of aluminum. The peripheral portion was 10 mm wide, and was electrically connected to the cathode. The distance between the mask and the aluminum was approximately 3 mm, but slight variations in distance may have occurred due to the flimsy nature of the cone and turbulent flow of the acid. An electrolyte of sulfuric acid (50 degrees C.) was pumped into the cell at a rate of 3.0 $m^3$/hour. The aluminum cone was anodized at an average current density of 90 A/$dm^2$. After 20 seconds, an oxide layer was formed on the surface of the cone. The thickness of the oxide layer was roughly constant at ten microns from the periphery down to a cone diameter of approximately 35 mm and then tapered to a minimum of 2 microns at the neck (center) of the cone.

EXAMPLE 6

Two substrates comprising disks of aluminum grade 1200 were anodized. The disks were 100 mm in diameter and 2.0 mm thick. The electrolyte employed was approximately 175 g/l sulphuric acid and 25 g/l aluminum. The cell was operated at 48-52 degrees Celsius and the flow rate through the cell was 3.0 $m^3$/hr. Anodizing time was 22 seconds. Mask A was a plain polypropylene disk of 69 mm in diameter. Mask B was of similar construction except that the outer 5 mm comprised an aluminum ring connected to the cathode of the cell. Mask C was of similar form but constructed of aluminum and connected to the cathode. Mask C, in effect, provided no masking. Six measurements of coating thickness were made on each specimen, approximately equispaced from the center to the periphery of the disk (reference 1 at center-reference 6 close to the periphery). The coating thicknesses were measured by the eddy current method according to BS5411 Pt. 3. The results are set forth in Table 1 below:

TABLE 1

| | Sample Ref. | Mask spacing (mm) | Current (A) | Coating thickness (microns) No. 1 | No. 2 | No. 3 | No. 4 | No. 5 | No. 6 | Ratio No's 6:1 | Range 1-6 | Range 5-6 |
|---|---|---|---|---|---|---|---|---|---|---|---|---|
| MASK A | 11 | 1.75 | 20 | 2 | 3 | 3 | 6 | 10 | 14 | 7:1 | 12 | 4 |
| | 12 | 1.75 | 30 | 2 | 3 | 4 | 12 | 17 | 19 | 9.5:1 | 17 | 4 |
| | 13 | 3.15 | 20 | 3 | 6 | 7 | 9 | 14 | 15 | 5:1 | 12 | 1 |
| | 14 | 3.15 | 30 | 2 | 3 | 4 | 10 | 15 | 19 | 9.5:1 | 17 | 4 |
| | 15 | 3.8 | 20 | 3 | 4 | 6 | 8 | 12 | 14 | 4.7:1 | 11 | 2 |
| | 16 | 3.8 | 30 | 3.5 | 6 | 6 | 12 | 13 | 17 | 4.9:1 | 14.5 | 4 |
| MASK B | 40 | 1.92 | 20 | 2 | 2 | 3 | 7 | 13 | 14 | 7:1 | 12 | 1 |
| | 20 | 1.92 | 30 | 2 | 2 | 3 | 12 | 17 | 17 | 8.5:1 | 15 | 0 |
| | 17 | 2.59 | 20 | 2 | 3 | 3 | 7 | 12 | 10 | 5:1 | 8 | 2 |
| | 18 | 2.59 | 30 | 3 | 3 | 3 | 12 | 18 | 18 | 6:1 | 15 | 0 |
| | 22 | 3.98 | 20 | 2 | 2 | 2 | 4 | 8 | 10 | 5:1 | 8 | 2 |
| | 21 | 3.98 | 30 | 3 | 4 | 4 | 10 | 14 | 18 | 6:1 | 15 | 4 |
| MASK C | 20 | n/a | 30 | 12 | 12 | 12 | 13 | 13 | 13 | 1:1 | | |

Processes employing Masks A and B produced tapered coatings. In this example, an increase in current density increased the ratio of thickness between the maxima and the minima. Decreasing the space between the mask and the substrate increased the ratio of thickness between the maxima and minima. Placing a ring of metal at the periphery of the mask and attaching the mask to the cathode produced a corresponding ring of coating of nearly uniform thickness and a sharper tapered coating inward of the ring. This effect was greater at higher current densities. The process employing Mask C resulted in no taper.

EXAMPLE 7

The procedure of Example 6 was repeated except Mask D comprised a structure 17 mm thick, having round holes of graded diameter in the form of a rough double 'X' centered on the specimen. Measurements of coating thickness were taken at various points. The coating thicknesses were measured by the eddy current method according to BS5411 Pt. The results are set forth at Table 2, below:

TABLE 2

| | Sample Ref. | Mask spacing (mm) | Current (A) | Coating thickness (microns) No. 1 | No. 2 | No. 3 | No. 4 | No. 5 | No. 6 | Ratio No's 4:1 | Range 1-4 | Range 5-6 |
|---|---|---|---|---|---|---|---|---|---|---|---|---|
| MASK D | 33 | 0.85 | 12.5 | 2 | 15 | 18 | 17 | 17 | 6 | 8.5:1 | 15 | 11 |
| | 34 | 0.85 | 16 | 2 | 14 | 17 | 18 | 15 | 6 | 9:1 | 16 | 9 |
| | 31 | 1.16 | 13 | 1 | 13 | 14 | 17 | 12 | 6 | 17:1 | 16 | 6 |
| | 32 | 1.16 | 17 | 2 | 15 | 15 | 18 | 17 | 9 | 9:1 | 16 | 8 |
| | 29 | 1.8 | 10.5 | 2 | 8 | 12 | 17 | 10 | 7 | 8.5:1 | 15 | 3 |
| | 30 | 1.8 | 13 | 2 | 7 | 12 | 12 | 7 | 1 | 6:1 | 10 | 6 |

In this example, increasing the size of the holes in the mask resulted in increased coating thickness in the corresponding area of the specimen. Reducing the spacing between mask and substrate produced a sharper taper between areas of different coating thickness on the specimen. Increasing the current density produced a sharper taper between areas of different coating thickness on the substrate.

EXAMPLE 8

Two commercially manufactured loudspeaker cones, of 120 mm and 75 mm respectively, were anodized. The 120 mm cone was masked as shown in FIG. 10. The 75 mm cone was masked as shown in FIG. 14. The electrolyte concentration was approximately 250 g/l and 5 g/l aluminum at 47 to 51 degrees Celsius. The mean current density was 90 A/dm$^2$. Five measurements of coating thickness were made on each cone, approximately equispaced from the junction of the cone neck (reference 1) to the periphery of the conical portion (reference 2). The coating thicknesses were measured by the micrometer method. The results are set forth in Tables 3 and 4 below:

TABLE 3

| (120 mm cone) Measurement Point | Coating in Microns |
|---|---|
| 1 | 2 |
| 2 | 4 |

TABLE 3-continued

| (120 mm cone) | |
|---|---|
| Measurement Point | Coating in Microns |
| 3 | 6 |
| 4 | 7.5 |
| 5 | 9 |

TABLE 4

| (75 mm cone) | |
|---|---|
| Measurement Point | Coating in Microns |
| 1 | 1 |
| 2 | 4 |
| 3 | 10 |
| 4 | 9.5 |
| 5 | 10 |

EXAMPLE 8

A third commercially manufactured 75 mm loudspeaker cone was anodized using a mask pierced by a concentric ring of holes 1.5 mm in diameter at 80 mm pitch circle diameter. The mask was spaced approximately 1 mm from the surface of the cone. The cone was anodized under conditions similar to those described in Example 7. Six measurements of coating thickness were made on each one, approximately equispaced from the junction of the cone neck (reference 1) to the periphery of the conical portion (reference 2). The coating thicknesses were measured by the micrometer method. The results are set forth in Table 5 below:

TABLE 5

| (perforated mask) | |
|---|---|
| Measurement Point | Coating in Microns |
| 1 | 1 |
| 2 | 1 |
| 3 | 7 |
| 4 | 6 |
| 5 | 3 |
| 6 | 5* |

*The thick coating at the periphery (measurement point 6) was believed due to current leakage in the cell.

The loudspeaker diaphragm of the invention may be incorporated into any loudspeaker, including sub woofers, bass, and midrange loudspeakers. The diaphragms may also be suitable for use in loudspeakers for automobile applications.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A loudspeaker diaphragm having an acoustic region, the loudspeaker diaphragm comprising:

a conical region having an inner and outer surface, a cylindrical region radially inward of the conical region, the cylindrical region having an inner and outer surface, a coating formed on at least one surface of the conical region and the cylindrical region;

where the coating tapers in the conical region, and where the coating is a uniform thickness in the cylindrical region.

2. The loudspeaker diaphragm of claim 1 where the coating comprises a continuous layer.

3. The loudspeaker diaphragm of claim 2 where the diaphragm is at least partially formed of aluminum, titanium, magnesium, an alloy of aluminum, titanium, magnesium, or combinations thereof.

4. The loudspeaker diaphragm of claim 3 where the coating is formed of a carbide, boride, nitride, or oxide.

5. The loudspeaker diaphragm of claim 4 where the coating has a thickness of from about 0.1 microns to about 8 microns in the cylindrical region and a thickness from about 2 microns to about 100 microns in the conical region.

6. The loudspeaker diaphragm of claim 4 where the coating is an anodically formed oxide layer.

7. The loudspeaker diaphragm of claim 1 where the conical region comprises at least a portion of the acoustic region of the diaphragm.

8. The loudspeaker diaphragm of claim 1 where at least portions of both the inner and outer surfaces of the conical region are coated.

9. The loudspeaker diaphragm of claim 8 where at least portions of both the inner and outer surfaces of the cylindrical region are coated.

10. A loudspeaker diaphragm comprising:

a conical region, a cylindrical region, a transition region between the conical region and the cylindrical region, and a continuous coating formed on at least one major surface of the conical region, the cylindrical region, and the transition region, where the coating in at least the transition region is tapered.

11. The loudspeaker diaphragm of claim 10 where at least a portion of the coating in the conical region is tapered.

12. The loudspeaker diaphragm of claim 11 where the coating in the cylindrical region is of substantially uniform thickness.

13. The loudspeaker diaphragm of claim 11 where the coating in the cylindrical region is tapered.

14. The loudspeaker diaphragm of claim 13 where the coating tapers from a maximum value in the conical region to a minimum value in the cylindrical region.

15. The loudspeaker diaphragm of claim 10 where a one portion of the coating in the conical region is tapered and another portion of the coating is of substantially uniform thickness.

16. The loudspeaker diaphragm of claim 15 where the portion of the coating of substantially uniform thickness is radially outward of the tapered portion.

17. The loudspeaker diaphragm of claim 10 where the diaphragm is at least partially formed of aluminum, titanium, magnesium, an alloy of aluminum, titanium, magnesium, or combinations thereof.

18. The loudspeaker diaphragm of claim 17 where the coating is formed of a carbide, boride, nitride, or oxide.

19. The loudspeaker diaphragm of claim 10 where the coating has a thickness from about 0.1 microns to about 8 microns in the cylindrical region and a thickness from about 2 microns to about 100 microns in the conical region.

20. The loudspeaker diaphragm of claim 18 where the coating is an anodically formed oxide layer.

21. A loudspeaker diaphragm comprising:

a conical portion a cylindrical portion, and a coating formed on at least one major surface of at least the conical and cylindrical portions, where the coating tapers from a maximum value on the conical portion to a minimum value on the cylindrical portion.

22. The loudspeaker diaphragm of claim 21 where the coating is continuous.

23. The loudspeaker diaphragm of claim 22 where the coating tapers from a maximum value at the periphery of the conical region to a minimum value in the cylindrical portion.

24. The loudspeaker diaphragm of claim 23 where the thickness of the coating in the cylindrical portion is uniform.

25. The loudspeaker diaphragm of claim 22 where the thickness of the coating in an area of the conical portion adjacent the periphery of the conical portion is uniform.

26. The loudspeaker diaphragm of claim 22 where the continuous coating is an anodically formed oxide layer.

27. The loudspeaker diaphragm of claim 22 including a dome attached to a surface of the coating on the conical portion.

28. The loudspeaker diaphragm of claim 27 where the coating on conical portion outside the dome is of uniform thickness and the coating on the conical portion inward of the dome is tapered.

* * * * *